US009399536B2

(12) United States Patent
Bertone

(10) Patent No.: US 9,399,536 B2
(45) Date of Patent: Jul. 26, 2016

(54) CLOSURE CLASPED GABLE-TOPPED FOOD CARTON

(71) Applicant: Anthony J. Bertone, Katonah, NY (US)

(72) Inventor: Anthony J. Bertone, Katonah, NY (US)

( * ) Notice: Subject to any disclaimer, the term of this patent is extended or adjusted under 35 U.S.C. 154(b) by 0 days.

(21) Appl. No.: 14/523,186

(22) Filed: Oct. 24, 2014

(65) Prior Publication Data

US 2016/0114931 A1 Apr. 28, 2016

(51) Int. Cl.
*B65D 5/06* (2006.01)
*B65D 5/42* (2006.01)

(52) U.S. Cl.
CPC ..... *B65D 5/068* (2013.01); *B65D 5/069* (2013.01)

(58) Field of Classification Search
CPC ..... B65D 5/069; B65D 5/066; B65D 5/6611; B65D 5/6647; B65D 5/2066
USPC ..... 229/125.39, 125.41, 181, 189, 198
See application file for complete search history.

(56) References Cited

U.S. PATENT DOCUMENTS 899,612 A * 9/1908 Phillips ..... B65D 33/1675 24/30.5 R
1,037,132 A * 8/1912 Cohen ..... B65D 5/347 229/189
1,690,853 A * 11/1928 Behrman ..... B65D 5/14 206/807
1,822,936 A * 9/1931 Reichel ..... B65D 5/18 229/125.37
2,200,320 A * 5/1940 Zalkind ..... A47B 88/0003 229/117.23
2,379,665 A * 7/1945 Stone ..... B65D 5/3685 229/117.05
2,682,423 A * 6/1954 Ashworth ..... E05C 19/06 229/125.39
2,688,507 A * 9/1954 Ashworth ..... F16B 5/0657 2/96
3,217,967 A 11/1965 Jackson
4,768,704 A 9/1988 Beckway et al.
4,979,668 A * 12/1990 Allen ..... B65D 5/069 229/125.12
5,507,431 A 4/1996 Bertone
6,047,883 A 4/2000 Calvert et al.
6,050,484 A 4/2000 Galomb
6,948,652 B2 * 9/2005 Andersson ..... B65D 5/069 229/125.39
2004/0069843 A1 4/2004 Huffman et al.
2012/0012489 A1 1/2012 Mongan et al.

* cited by examiner

*Primary Examiner* — Gary Elkins
(74) *Attorney, Agent, or Firm* — Gordon & Jacobson, P.C.

(57) ABSTRACT

A gable topped food carton is provided having a closure device. The carton has a pour spout with a pair of folded ridge portions. The carton includes a male stud attached to a first of the folded ridge portions and a female socket attached to a second of the folded ridge portions. The male stud is constructed to couple with the female socket to close the pour spout.

15 Claims, 8 Drawing Sheets

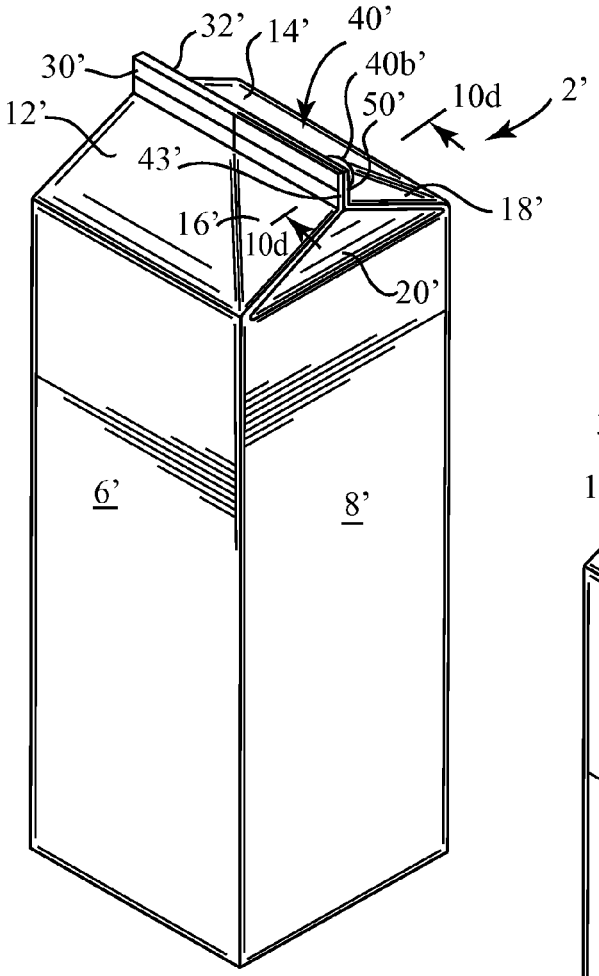
Fig. 8
Fig. 9
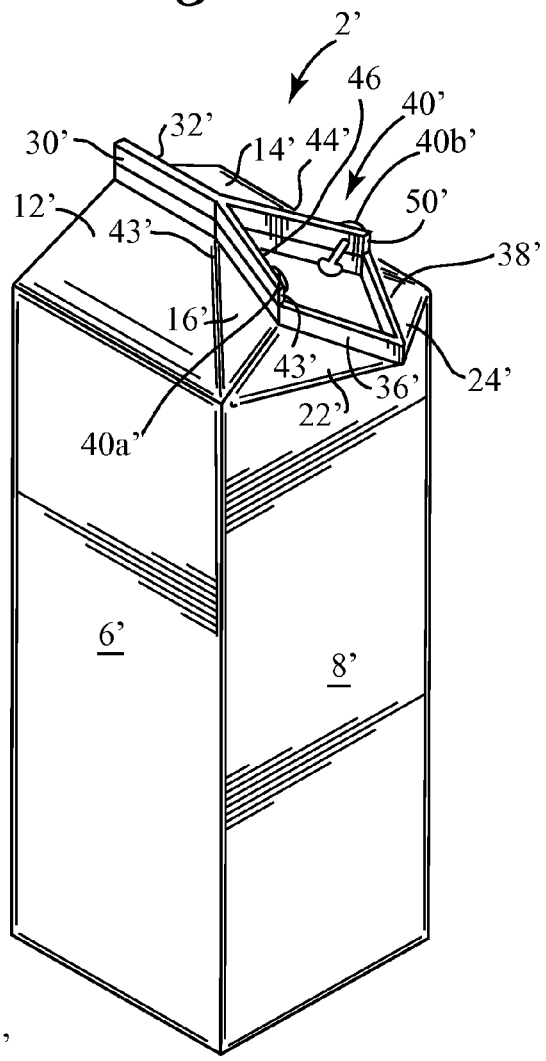
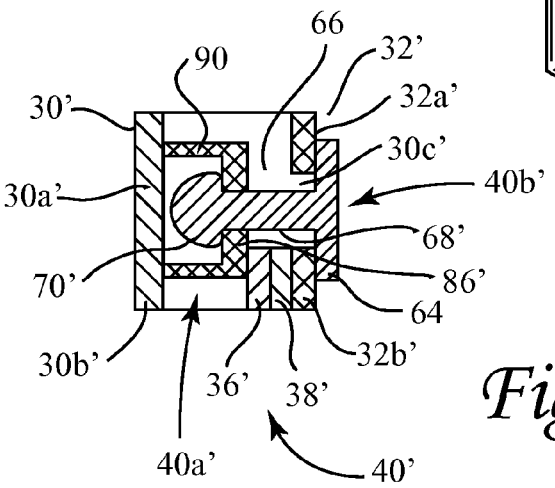
Fig. 10d

CLOSURE CLASPED GABLE-TOPPED FOOD CARTON

BACKGROUND

1. Field

This present disclosure relates to gable top carton container closures. The present disclosure more particularly relates to cartons for packaging and dispensing fluid/liquid or dry food products through a pour spout formed when a common gable top carton is unsealed and the closure clasp manipulated to the open position.

2. State of the Art

Food cartons for the dispensing of fluid are often constructed from flat forms with the surfaces coated with a plastic, such as polyethylene. This construction provides strength, makes the carton impervious to penetration by liquids carried in the carton, and serves to protect the contents within the carton from outside pollutants. While the aforementioned gable topped cartons are widely used to generally securely and safely store the food contents before sale, they are often difficult to open. The folds of the gable top which are used to form a spout are often ripped and/or damaged by the user in an attempt to spread the folds during the initial opening of the container. Consequently the spout is often either partially or totally destroyed resulting in spillage and/or awkwardness while pouring the contents of the carton. In addition, once opened, the gable top may be folded back for closure. However, if the closure is not tightly sealed, the contents, over a period of time, have a tendency to spoil or absorb noxious odors from surrounding foods in the typical household refrigerator. Also, if the container is accidentally knocked over, the contents are spilled over other items stored in the refrigerator resulting in liquid dripping down over other shelves of the refrigerator, forming a general mess requiring a time consuming and annoying clean up.

SUMMARY

A gable topped food carton is provided having a closure device. The carton has a pour spout with a pair of folded ridge portions. The carton includes a male stud that is attached to a first of the folded ridge portions and a female socket attached to a second of the folded ridge portions. The male stud is constructed to removably couple with the female socket to close the pout spout.

BRIEF DESCRIPTION OF THE DRAWINGS

FIG. 8 is a perspective view of an assembled milk container assembled form the blank of FIG. 7 having a gable closure and incorporating an alternative closure clasp, shown from a front side quarter of the closed container.

FIG. 9 is a view of the container shown in FIG. 8 showing the closure and spout of the container opened.

FIG. 10*d* is a sectional view of the carton shown in FIG. 8 taken along lines 10*d*-10*d*.

DETAILED DESCRIPTION

Figure 1:
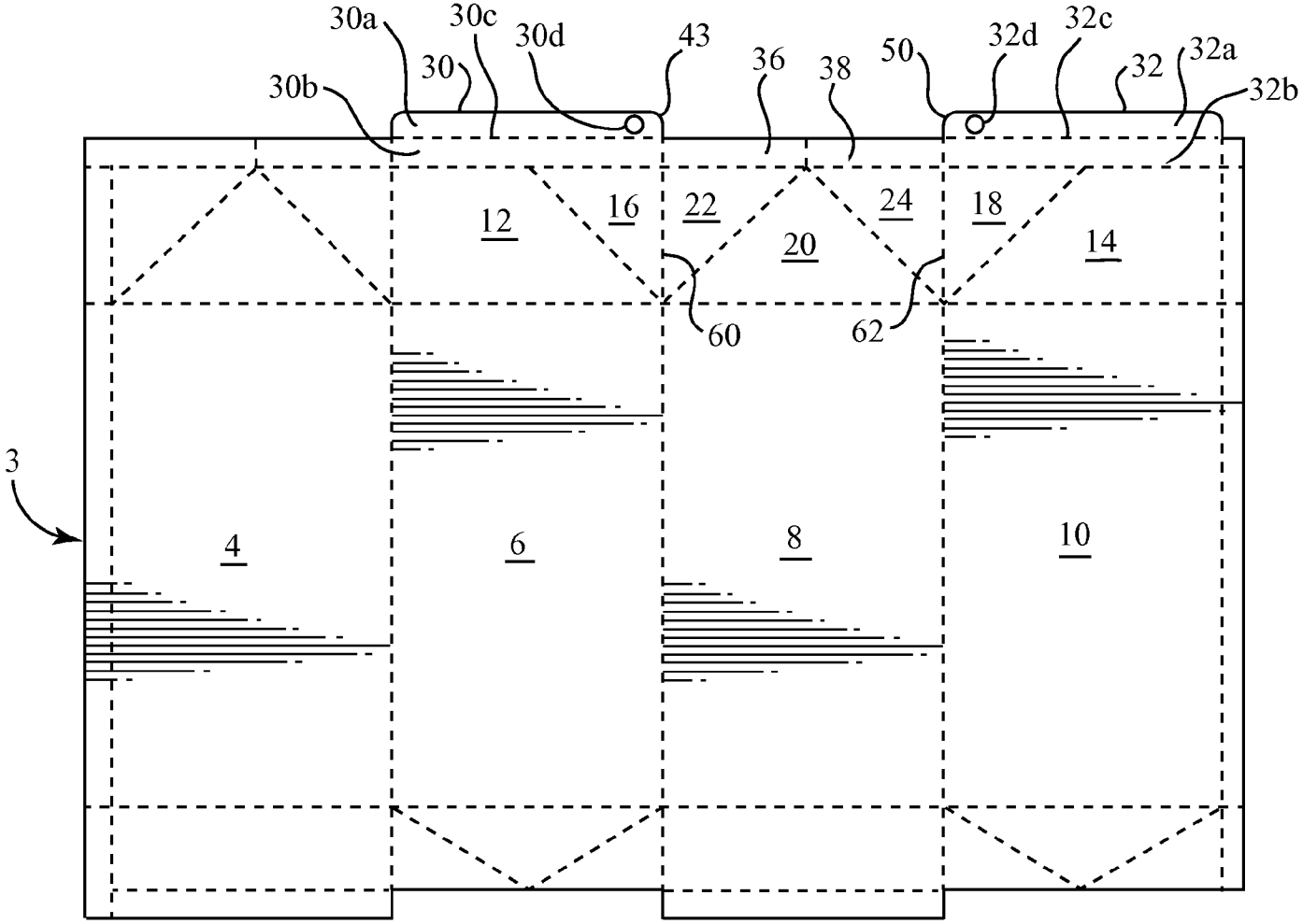
FIG. 1 is a plan view of a gable topped milk container blank formed in accordance with one embodiment.
Figure 2:
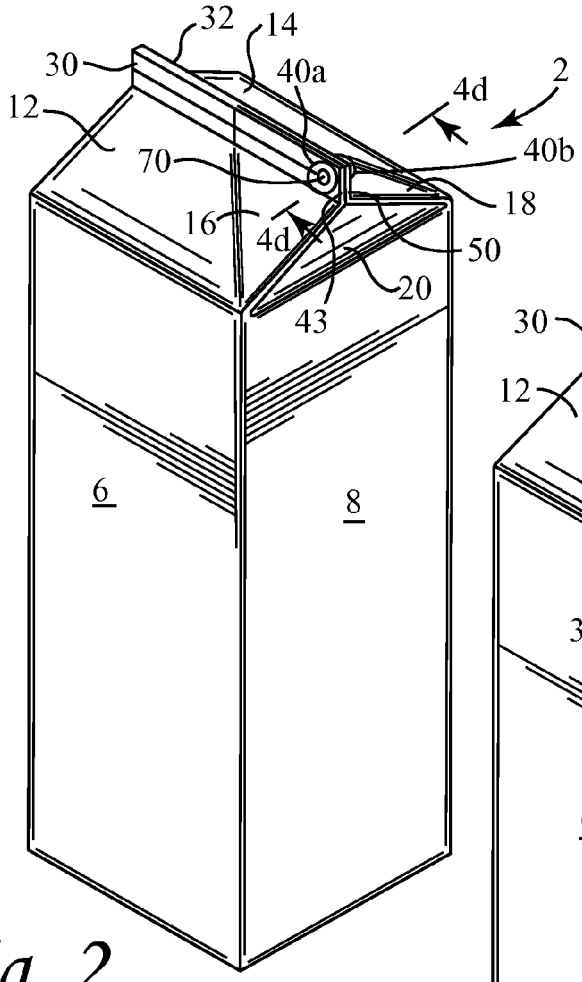
FIG. 2 is a perspective view of an assembled milk carton container with gable closure shown from the front and a side quarter and shown with a closure in a closed position.
Figure 3:
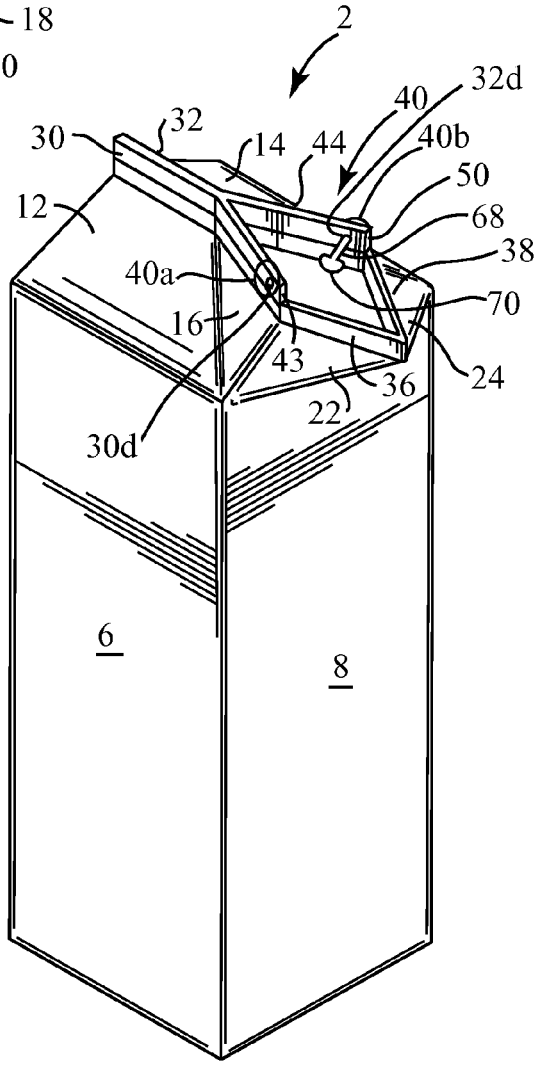
FIG. 3 is a perspective view of the assembled milk carton container shown in FIG. 2 with a spout and the closure thereof opened.

FIG. 1 shows a blank 3 used to form a milk carton 2, shown in FIGS. 2 and 3. Unless otherwise noted, the dotted lines in FIG. 1 indicate fold lines utilized in the assembly of the carton 2, which is heat sealed and/or glued together. The blank 3 includes a rear panel 4, right side panel 6, front panel 8, and left side panel 10. The upper portion of the blank 3 includes a first gable side 12 and a second gable side 14. The first gable side 12 has a forward portion 16 and the second gable side 14 has a forward portion 18. The forward portions 16 and 18 form a portion of a spout of the carton 2, shown most clearly in FIG. 3. The first gable side 12 has an upper ridge portion 30 and the second gable side 14 has an upper ridge portion 32. The upper ridge portion 30 has an upper section 30*a* and a lower section 30*b* divided by horizontal broken line 30*c*. The upper ridge portion 32 has an upper section 32*a* and a lower section 32*b* divided by a horizontal broken line 32*c*. A hole 30*d* is formed in the upper section 30*a* of the upper ridge portion 30 and a hole 32*d* is formed in the upper section 32*a* of the upper ridge portion 32. Hole 30*d* is located proximate to a vertical edge 43 of the upper section 30*a*. Hole 32*d* is located proximate to vertical edge 50 of the upper section 32*a*. When the blank 3 is assembled into a sealed carton 2 as shown in FIG. 2, the holes 30*c* and 32*c* are aligned and form a passageway through which a snap closure is operatively disposed, as will be discussed in greater detail below.

In one aspect, the lower section 30*b* of the upper ridge portion 30 is laterally aligned with a rim portion 36 of a spout side 22 and the lower section 32*b* of the upper ridge portion 32 is laterally aligned with a rim portion 38 of a spout side 24. When the blank 3 is folded and the carton 2 is assembled into a sealed carton the forward portion 16 and the spout side 22 form a fold along broken line 60 and the forward portion 18 and spout side 24 form a fold along broken line 62. When the blank 3 is folded and assembled into a sealed carton 2, as shown in FIG. 2, the lower section 30*b* is sealed with the rim portion 36 of the spout side 22 and the lower section 32*b* is sealed with the rim portion 38 of the spout side 24. Also, it is noted that when the carton 2 is sealed, upper sections 30*a* and 32*a* are sealed to each other.

Figure 5:
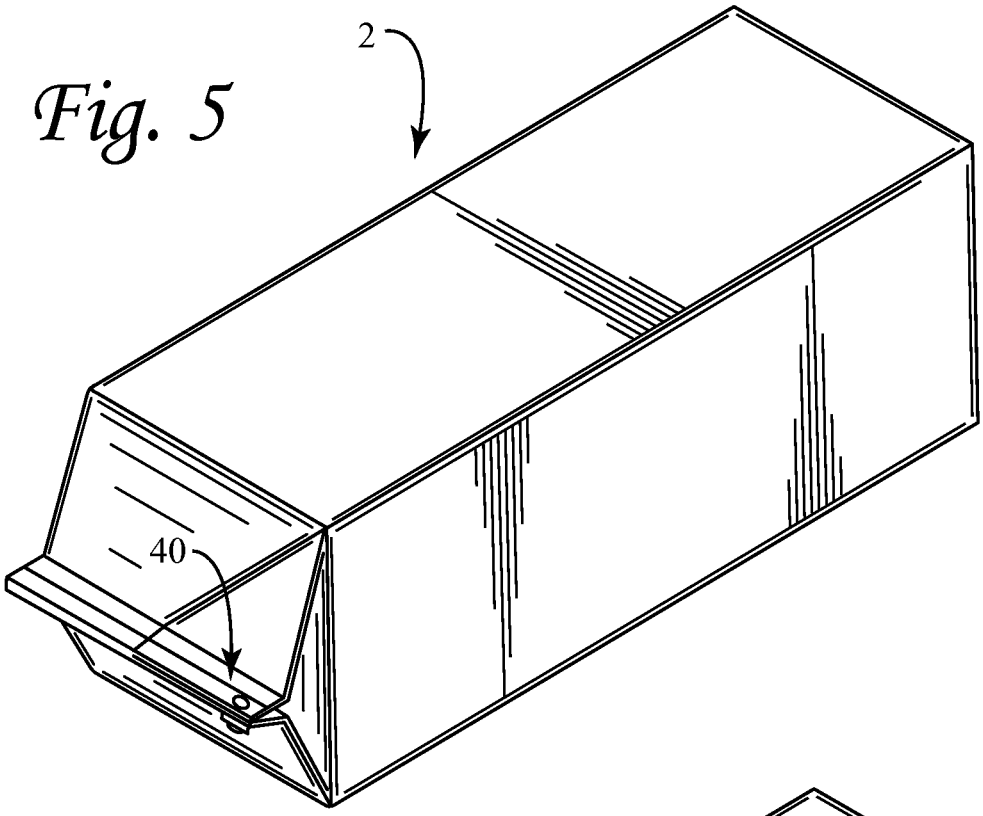
FIG. 5 is a perspective view of a previously opened container constructed as shown in FIG. 2 laying on a side thereof with its gable top reclosed.

As shown in FIGS. 2, 3, and 5, the milk carton 2 has a gable roof closure. During opening of the sealed carton 2, the upper ridge portions 30 and 32, and the rim portions 36 and 38 can be pulled apart to unfold the forward portions 16 and 18 and the spout sides 22 and 24 to form a spout, as shown in FIG. 3. In practice however, it is often difficult for the user to initially unseal the carton 2 when opening the spout without ripping some portions of ridge sections 32*a*, 32*b*, 30*a*, 30*b* and rim portions 36 and 38, which can prevent proper closure of the spout, thereby allowing the contents inside the carton to be exposed to the external environment of the carton and consequently leading to premature spoilation of the contents.

In one aspect, the gable sides 12 and 14 are generally formed in a conventional manner except that they include respective portions 40*a* and 40*b* of a snap closure 40, shown in greater detail in FIGS. 3 and 4(*a*)-4(*d*). The upper ridge portion 30 retains a female portion 40*a* of the snap closure 40 and upper ridge portion 32 retains a male portion 40*b* of the snap closure 40. It will be appreciated that the positioning of the female and male portions 40*a* and 40*b* can be reversed, i.e., retaining the female portion 40*a* on the upper ridge portion 32 and retaining the male portion 40*b* on the upper ridge portion 30.

Figure 4D:
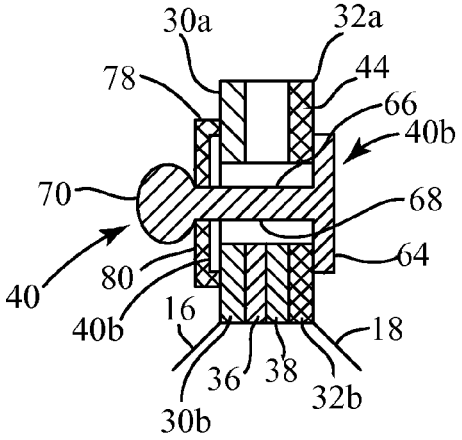
FIG. 4*d* is a sectional view of a portion of the carton shown in FIG. 2 taken along lines 4*d*-4*d*.
Figure 4A:
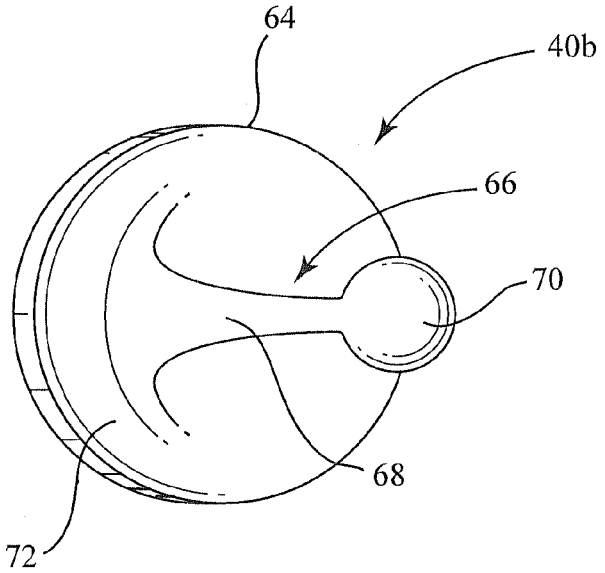
FIG. 4*a* is an isometric view of a male closure member in accordance with an embodiment.

FIG. 4*a* shows a detailed view of the male portion 40*b* of the closure 40. The male portion 40*b* has a base 64 and an elongated stud 66 extending generally perpendicular from the base 64. The stud 66 has a proximal portion 68 (proximal with respect to the base) directly attached to the base 64 and a distal portion 70 opposite the base 64. The distal portion 70 has a relatively larger diameter compared to the diameter of the proximal portion 68. In one embodiment, the distal portion 70 has an outer surface that is generally spherical. An inner side or face 72 of the base 64 is constructed for attachment to an outer side 44 (FIGS. 3 and 4*d*) of the upper ridge portion 32. In one embodiment, the inner side 72 of the base 64 is adhesively attached (e.g., glued) to the outer side 44.

Figure 4B:
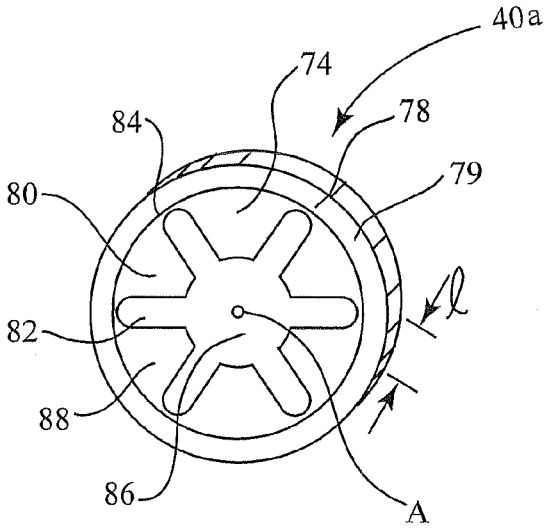
FIG. 4*b* is an isometric view of a female closure member, shown from the front and a side thereof, in accordance with an embodiment.
Figure 4C:
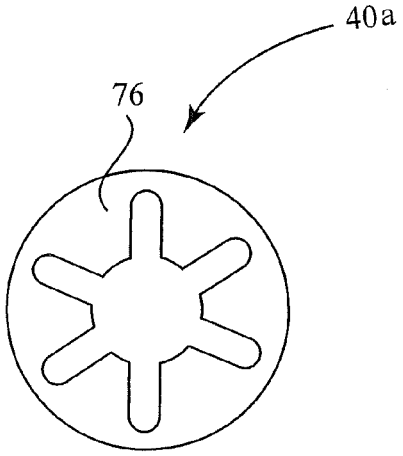
FIG. 4*c* is a rear elevation view of the female closure member shown in FIG. 4*b*.

FIGS. 4*b* and 4*c* show a detailed view of the female portion 40*a* of the closure 40. The female portion 40*a* has an inner side 74 shown in FIG. 4*b* and an outer side 76 shown in FIG. 4*c*. The terms inner and outer refer to the orientation of the sides of the female portion 40*a* when the female portion 40*a* is attached to the upper ridge portion 30.

The inner side 74 has an annular rim 78 that surrounds a hub 80. The hub 80 is recessed with respect to a planar surface (face) 79 of the rim 78. The hub 80 defines a plurality of radially extending slots 82 that extend radially inwardly from an inner circumference 84 of the rim 78. Each slot 82 extends radially inwardly and intersects with a circular aperture or opening 86. The aperture 86 has a diameter that is less than the diameter of the distal portion 70 of the stud 66, but is greater than the diameter of the proximal portion 68 of the stud 66. The slots 82 define substantially triangular projections 88 therebetween. The projections 88 form a socket that is constructed to removably couple with the stud 66 of the male portion 40*b*. The projections 88 are constructed to resiliently deflect axially along axis A (FIG. 4*b*) from an undeflected state shown in FIGS. 4*b* and 4*c* to enlarge the aperture 86 during a closure operation of the closure 40. Specifically, during a closure operation of the closure 40 the distal portion 70 of the male portion 40*b* is positioned over the aperture 86, which has smaller diameter than the distal portion 70, and is pushed against the projections 88, whereupon the projections 88 resiliently deflect slightly axially along axis A to enlarge the aperture 86 sufficiently to permit the distal portion 70 of the stud 66 to pass through the aperture 86. As the distal portion 70 passes through the aperture 86, the projections 88 deflect back to their rest state to inhibit the distal portion 70 from moving back through the aperture 86. The distal portion 70 can move back through the aperture 86 in the same manner it enters, i.e., by applying a sufficient force to the distal portion 70 to deflect the projections 88 to enlarge the aperture. Thus, the distal portion 70 of the male portion 40*b* is constructed to be pushed through the opening 86 of the female portion 40*a* and snap together with the female portion 40*a* so that the portions 40*a*, 40*b* are removably coupled.

In one embodiment, the male and female portions 40*b* and 40*a* of the closure 40 are plastic. By way of example and not by way of limitation, the male and female portions may be made of polypropylene or polyethylene. In one embodiment the base 64 of the male portion 40*b* is round and has a diameter of approximately 0.45 inch. In one embodiment the distal portion 70 of the male portion 40*b* has a diameter of approximately 0.15 inch. In one embodiment the stud 66 is approximately 0.25 inch long. In one embodiment the rim 78 of the female portion has an outer diameter of approximately 0.45 inch.

FIG. 4*d* shows a view of an upper portion of the carton 2 through section 4*d*-4*d* in FIG. 2 and illustrates the arrangement of the closure snap 40 and the upper ridge portions 30 and 32 when the closure 40 is closed. As discussed above, holes 30*d* and 32*d* align with one another when the spout is closed and/or the carton 2 is sealed. The holes 30*d* and 32*d* are formed in the upper sections 30*a* and 32*a* so that the portions 40*a* and 40*b* of the closure 40 do not interfere with the unfolding of the spout, as shown, for example, in FIG. 3. As discussed above, the male portion 40*b* is adhesively attached to the outer side of the upper ridge portion 32 while the female portion 40*a* is adhesively attached to the outer side of the upper ridge portion 30. Specifically, the female portion 40*a* is constructed to be adhesively attached to the outer side of the upper ridge portion 30 along the surface 79 of the rim 78. The holes 30*d* and 32*d* receive the stud 66 of the male portion 40*b* therethrough and, therefore, the holes 30*d* and 32*d* have diameters that are at least as large as the diameter of the distal portion 70 of the stud 66. As shown in FIG. 4*d*, when in the closed position, the stud 66 passes through aligned holes 30*d* and 32*d* in the upper ridge portions 30 and 32, respectively, and the aperture 86 formed in the female portion 40*a*. Thus, when the snap closure 40 is closed, the fold formed by forward portion 16 and spout side 22, and the fold formed by forward portion 18 and spout side 24 are firmly held against each other, leakage is prevented, and the closure securely sealed against contamination.

Figure 6:
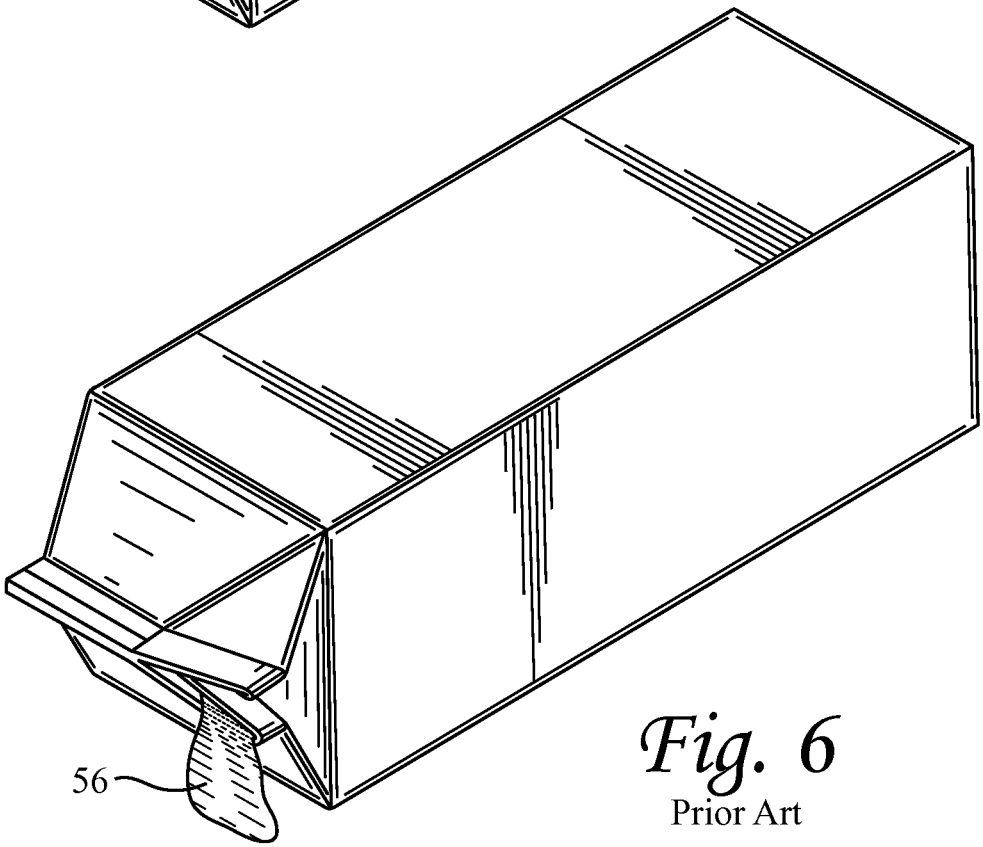
Fig. 6 Prior Art
FIG. 6 is a view of a prior art previously opened container laying on its side illustrating how the gable closure tends to spread open causing the contents to spill or escape.
Figure 7:
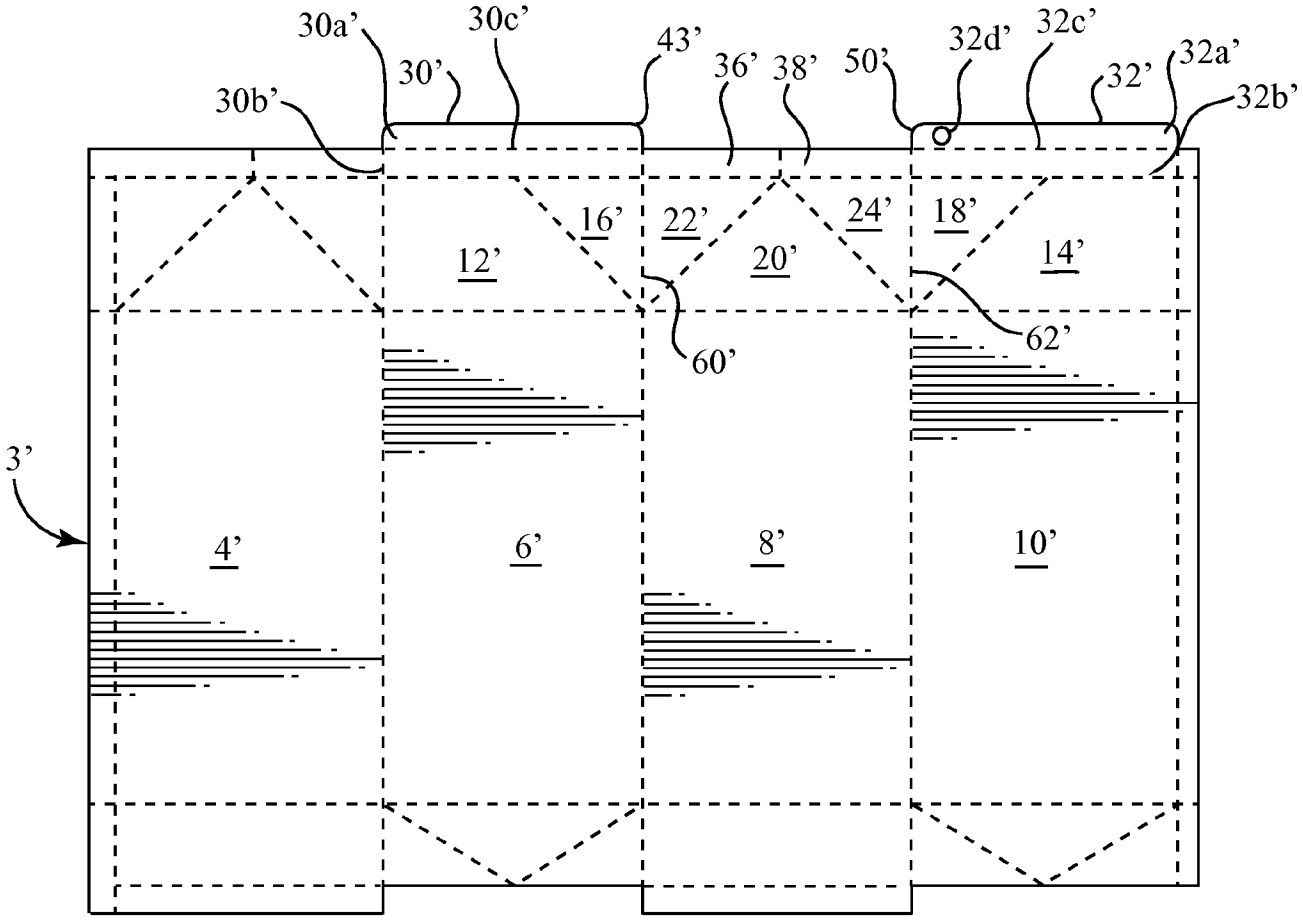
FIG. 7 is a plan view of an alternate embodiment of a milk container blank.

As shown in FIG. 5 a previously opened carton 2 equipped with the closure 40 that is snapped closed may be turned onto side 6 without any leakage. In contrast, FIG. 6 shows a prior art container that is not provided with the closure 40 that leaks when turned onto a side allowing liquid 56 to escape.

While the holes 30*d* and 32*d* and the snap closure 40 are located proximate to respective forward edges 43 and 50 of the upper sections 30*a* and 32*a*, in at least one alternate embodiment, those respective locations are further away from edges 43 and 50, and may be between the edges 43 and 50 and respective midpoints of the upper sections 30*a* and 32*a*. Such positioning of the closure 40 away from edges 43 and 50 may facilitate opening the snap closure 40 by providing gripping areas on the upper ridge portions 30 and 32 between the location of the snap closure 40 and the edges 43 and 50 on which a user can grasp for leverage to open the snap closure 40.

Figure 10A:
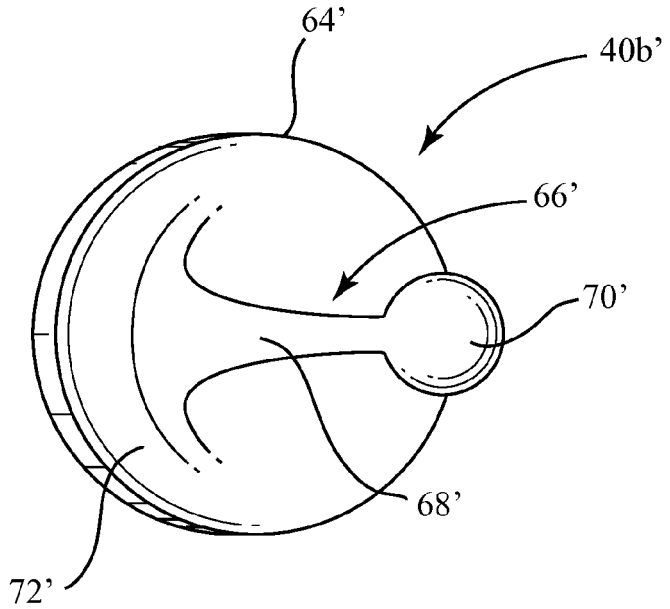
FIG. 10*a* is an isometric view of a male closure member in accordance with an alternate embodiment.
Figure 10B:
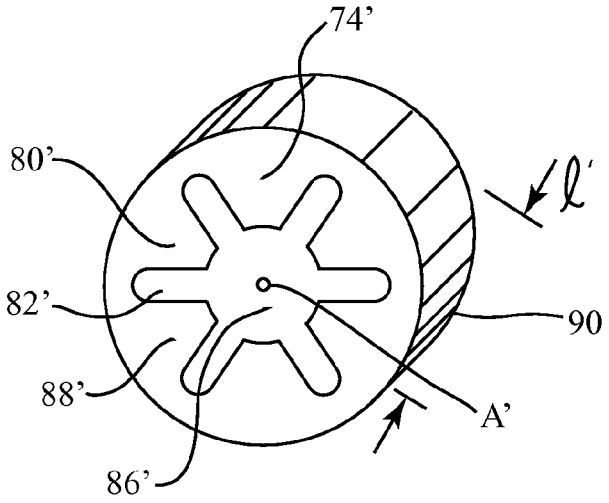
FIG. 10*b* is an isometric view of a female closure member, shown from a front and a side, in accordance with an alternate embodiment.
Figure 10C:
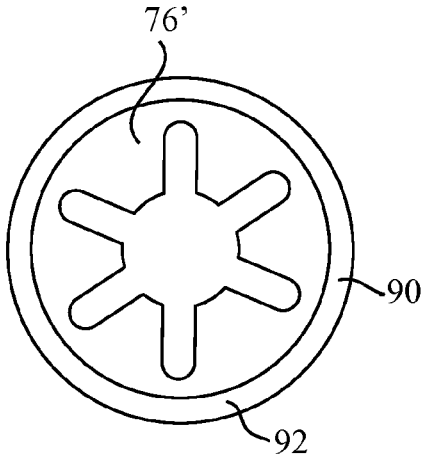
FIG. 10*c* is a rear elevation view of the female closure member shown in FIG. 10*b*.

An alternate embodiment of a carton 2' is shown in FIGS. 7 through 10*d*, where like elements to those of the carton 2 are appended with an apostrophe ('). Notably, the carton 2' differs from carton 2 in the construction and arrangement of a snap closure. Specifically, carton 2' has a snap closure 40' that includes a female portion 40*a'* and a male portion 40*b'*. Unlike the female portion 40*a* of snap closure 40, the female portion 40*a'* of snap closure 40' is attached to an inner side (rather than an outer side) of an upper ridge portion 30' of the carton 2', and is constructed so that a through hole (e.g., hole 30*d* of FIG. 1) is not formed in upper ridge portion 30'. Instead, the female portion 40*a'* of closure 40' is constructed like female portion 40*a*, except that female portion 40*a'* has a cylindrical extension 90 that extends from hub 80' such that the outer surface of the female portion 40*a'* has a length l' that is relatively longer than the length l (FIG. 4*b*) of rim 78 of female portion 40*a*. The longer length l' of female portion 40*a'* disposes the hub 80' farther away from the upper ridge portion 30' so that the distal portion 70' of a stud 66' of a male portion 40*b'* can be fully retained between the upper ridge portion 30' and the hub 80' when the female and male portions 40*a'* and 40*b'* are removably coupled together, as shown in FIGS. 8 and 10*d*.

FIG. 10*d* shows a view of an upper portion of the carton 2' through section 10*d*-10*d* in FIG. 8 and illustrates the arrangement of the closure snap 40' and the upper ridge portions 30' and 32' when the closure 40' is closed. As discussed above, only one hole 32*d'* is formed in the upper ridge portion 32'. The male portion 40*b'* is adhesively attached to an outer side 44' of the upper ridge portion 32' in much the same way as the male portion 40*b* is attached to the outer side 44 of the upper ridge portion 32. The stud 66' is attached to the upper ridge portion 32' so that it passes through hole 32*d'*.

The female portion 40*a'* is adhesively attached to an inner side 46 (FIG. 9) of the upper ridge portion 30' and is disposed between the upper ridge portion 30' and rim portion 36' so that rim portion 36' contacts a surface 79' (FIG. 10*b*) of hub 80' and upper ridge portion 30' contacts a surface 92 (FIG. 10*c*) of extension 90. The hole 32*d'* receives the stud 66 of the male portion 40*b'* therethrough and, therefore, the hole 32*d'* has a diameter that is at least as large as the diameter of the distal portion 70' of the stud 66'.

In the closed position, the stud 66' passes through the hole 86' formed in the female portion 40*a'* so that the distal portion 70' is retained between the hub 80' and the upper ridge portion 30'. Thus, when the snap closure 40' is closed, rim portions 36' and 38' are firmly held against each other preventing leakage and sealing the carton from external contamination. Also, when the closure 40' is closed, the upper sections 30*b'* and 32*b'* are spaced relatively farther apart than upper sections 30*b* and 32*b* shown in FIG. 4*d*.

Figure 11:
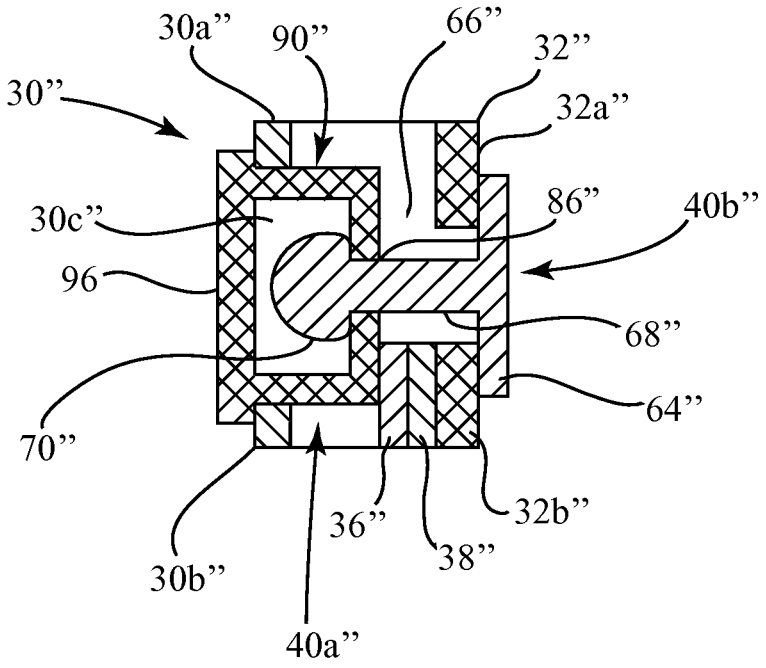
FIG. 11 is a sectional view of an alternate embodiment of a closure on a spout area of a carton.

FIG. 11 shows an alternate embodiment of the closure 40" shown in FIGS. 10*a*-10*d* where like structures are appended with two apostrophes ("). The closure 40" differs from closure 40' in that a female member 40*a"* has a base 96 attached to an extension 90" that spaces the base 96 from a hub 80". Also, unlike the extension 90 of female member 40*a'* shown in FIG. 10*d*, the extension 90" of female member 40*a"* shown in FIG. 10*e* extends through a hole 30*c"* formed in an upper ridge portion 30", and specifically through both an upper section 30*a"* and lower section 30*b"* of the upper ridge portion 30". An annular inner surface of base 96 adhesively attaches to an outer surface of the upper ridge portion 30" so that the aperture 86" aligns with stud 66" of male portion 40*b"*. In comparison with the relative locations of hub 80' and upper ridge portion 30' in FIG. 10*d*, the hub 80" in FIG. 10*e* is located closer to upper ridge portion 30". As a result, when the male and female portions 40*b"* and 40*a"* are coupled together, as shown in FIG. 10*e*, the distal portion 70" is partially located in the hole 30*c"* thereby reducing the distance between the upper ridge portions 30" and 32" when the closure 40" is closed, as compared to the distance between the upper ridge portions 30' and 32' when closure 40' is closed.

While the invention has been described by reference to illustrative embodiments, it is not intended that the novel device be limited thereby, but that modifications thereof are intended to be included as falling within the broad spirit and scope of the foregoing disclosure, the following claims and the appended drawings. For example, while certain examples of closures have been described herein having at least partially spherical shaped distal portions of a male portion, it will be appreciated that alternative shapes may be used, such as, for example cubic, ellipsoidal, diamond shaped, pyramidal. Also, while plastic may be used to form the part or all of the closures described herein, it will be appreciated that part or all of the closures may be formed of other materials, such as metal. Further, while specific dimensions of an embodiment of a closure have been provided herein, it will be appreciated that such dimensions can be modified or adjusted as deemed appropriate based on the design constraints, such as, for example, the geometry of the carton and the material properties of the closure. In addition, while the embodiments were described with reference to a milk carton, the embodiments are applicable to any cartons for packaging and dispensing fluid/liquid or dry food products through a pour spout. It will therefore be appreciated by those skilled in the art that yet other modifications could be made to the provided invention without deviating from its spirit and scope as claimed.

What is claimed is:

1. A gable topped food carton, comprising:

carton walls defining a pour spout with a pair of folded ridge portions;

a male stud attached to a first of said pair of folded ridge portions; and a female socket attached to a second of said pair of folded ridge portions, wherein said male stud is constructed to removably couple with said female socket to close said pour spout, said male stud extends from a base at a proximal end of said male stud to a distal portion spaced from said base by a proximal portion of said male stud, said distal portion having a diameter that is larger than a diameter of said proximal portion, and said male stud extends through a hole formed in said first of said pair of folded ridge portions, and said female socket defines an opening for receiving said distal portion of said male stud, said opening defining a plurality of radial slots extending from a central circular aperture.

2. The carton according to claim 1, wherein:

said hole is located between a midpoint and a distal edge of said first of said pair of folded ridge portions.

3. The carton according to claim 1, wherein:

said distal portion has at least a partially spherical outer surface.

4. The carton according to claim 1, wherein:

said base has a distal surface attached to an outer side of said first of said pair of folded ridge portions.

5. The carton according to claim 4, wherein:

said base is adhesively attached to said outer side of said first of said pair of folded ridge portions.

6. The carton according to claim 1, wherein:

said central circular aperture has a diameter that is smaller than said diameter of said distal portion of said male stud and larger than said diameter of said proximal portion of said male stud.

7. The carton according to claim 1, wherein:

said female socket is attached to an inner side of said second of said pair of folded ridge portions.

8. The carton according to claim 1, wherein:

said female socket is attached to an outer side of said second of said pair of folded ridge portions.

9. The carton according to claim 6, wherein:

when said pour spout is folded closed, said central circular aperture of said female socket is aligned with said male stud.

10. The carton according to claim 9, wherein:

said female socket is attached to an outer side of said second of said pair of folded ridge portions, and wherein said central circular aperture of said female socket is aligned with a hole formed through said second of said pair of folded ridge portions, said hole formed through said first of said pair of folded ridge portions, and said male stud.

11. The carton according to claim 10, wherein:

when said female socket and said male stud are coupled, said male stud extends through said central circular aperture formed in said female socket and through said second of said pair of folded ridge portions.

12. The carton according to claim 1, wherein:

said female socket comprises a plurality of substantially triangular projections, and wherein said projections are constructed to resiliently deflect in response to pushing said distal portion thereon and cause said central circular aperture to become enlarged.

13. A gable topped food carton comprising:

carton walls defining a pour spout with a pair of folded ridge portions;

a male stud extending through a hole formed in a first of said pair of folded ridge portions, said male stud extending from a base at a proximal end of said male stud and extending to a distal portion spaced from said base by a proximal portion of said male stud, said distal portion having a diameter that is larger than a diameter of said proximal portion; and a female socket attached to an outer side of a second of said pair of folded ridge portions, said female socket defining a slotted opening for receiving said distal portion of said male stud, and said slotted opening of said female socket defining a plurality of radial slots extending from a central aperture, wherein said male stud is constructed to removably couple with said female socket to close said pour spout.

14. The carton according to claim 13, wherein:

said distal portion has at least a partially spherical outer surface.

15. The carton according to claim 14, wherein:

said male stud is adhesively attached to an outer side of said first of said pair of folded ridge portions and said female socket is adhesively attached to said outer side of said second of said pair of folded ridge portions.

* * * * *